US010473001B2

(12) United States Patent
Kramer et al.

(10) Patent No.: US 10,473,001 B2
(45) Date of Patent: Nov. 12, 2019

(54) CONTROL VALVE FOR A CAMSHAFT ADJUSTER

(71) Applicant: Schaeffler Technologies AG & Co. KG, Herzogenaurach (DE)

(72) Inventors: Stefan Kramer, Langenzenn (DE); David Köhler, Egloffstein (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 33 days.

(21) Appl. No.: 15/737,335

(22) PCT Filed: Jun. 20, 2016

(86) PCT No.: PCT/DE2016/200284
§ 371 (c)(1),
(2) Date: Dec. 18, 2017

(87) PCT Pub. No.: WO2017/008792
PCT Pub. Date: Jan. 19, 2017

(65) Prior Publication Data

US 2018/0187578 A1 Jul. 5, 2018

(30) Foreign Application Priority Data

Jul. 14, 2015 (DE) ..... 10 2015 213 135

(51) Int. Cl.
*F01L 1/34* (2006.01)
*F01L 1/344* (2006.01)

(52) U.S. Cl.
CPC ... *F01L 1/3442* (2013.01); *F01L 2001/34433* (2013.01); *F01L 2101/00* (2013.01); *F01L 2250/02* (2013.01)

(58) Field of Classification Search
CPC ..... F01L 1/3443; F01L 2001/34433; F01L 2101/00; F01L 2250/02
(Continued)

(56) References Cited

U.S. PATENT DOCUMENTS 9,976,450 B2 * 5/2018 Haltiner, Jr. ..... F01L 1/047 123/90.17

FOREIGN PATENT DOCUMENTS

| | | | |
|---|---|---|---|
| DE | 102008004591 | A1 | 7/2009 |
| EP | 1945917 | A1 | 7/2008 |
| WO | 2008006717 | A1 | 1/2008 |

OTHER PUBLICATIONS

Hoppe et al., Hydraulic Control Valve, US Patent Application, Pub. No. US 2009/0230337, Sep. 17, 2009. (Year: 2009).*

* cited by examiner

*Primary Examiner* — Ching Chang
(74) *Attorney, Agent, or Firm* — Matthew V. Evans

(57) ABSTRACT

Control valves for a hydraulic camshaft adjuster are disclosed. In one example, the control valve includes a housing and a control piston mounted in a receiver of the housing. Several openings may be provided on an inner casing surface of the receiver, at least some of which may be assigned to an inlet port P, a supply port A, a supply port B or a supply port C. The control piston may include a first control groove, a second control groove and a third control groove which can each be connected to at least two openings of the housing depending on a position of the control piston relative to the housing. The first control groove may be configured to be brought into fluid-conductive connection with a first inlet opening assigned to the inlet port P and with an opening assigned to the supply port A. The second control groove may be configured to be brought into fluid-conductive connection with an opening assigned to the supply port A and/or with an opening assigned to the supply port B and/or with an opening assigned to the supply port C. The third control groove may be configured to be brought into fluid-conductive connection with the first inlet opening or a
(Continued)

second inlet opening assigned to the inlet port P and with an opening assigned to the supply port B.

8 Claims, 2 Drawing Sheets

(58) Field of Classification Search
USPC ..... 123/90.12, 90.15, 90.17
See application file for complete search history.

CONTROL VALVE FOR A CAMSHAFT ADJUSTER

CROSS-REFERENCE TO RELATED APPLICATIONS

This application is the U.S. National Phase of PCT Appln. No. PCT/DE2016/200284 filed Jun. 20, 2016, which claims priority to DE 102015213135.1 filed Jul. 14, 2015, the entire disclosures of which are incorporated by reference herein.

TECHNICAL FIELD

The disclosure lies in the field of proportional directional control valves which may be used as the central valves, in particular for the control of so-called camshaft adjusters. Camshaft adjusters serve to regulate the operation of an internal combustion engine in that the load change is influenced in a targeted fashion: adjustment of the phase position of the camshaft changes its position relative to the phase position of the crankshaft; thus the opening and closing times of the gas change valves can be shifted towards an earlier or later time in the cycle process performed. Central valves have several switch positions, by which the course of a pressure medium path between an inlet and an outlet can be adjusted—the pressure medium flow exerts a force on the camshaft adjuster which is dependent on the switch position and causes a shift into a specific position.

BACKGROUND

EP 1 945 917 A1 discloses a control valve for a camshaft adjuster with a control sleeve arranged inside a valve housing and a hollow cylindrical control piston guided displaceably therein. Hydraulic medium can reach a control groove, formed on the control piston, via a hydraulic medium path from a camshaft-side supply, via an axial channel formed between the control sleeve and the inner casing surface of the valve housing, and via an opening in the control sleeve. From the control groove, the hydraulic medium can reach a supply port A and/or B depending on the switch position. The supply ports A, B may alternatively also be brought into connection with an outlet port T. The outflowing pressure medium is conducted to the cylinder head or the timing case via the outlet port of the control valve.

SUMMARY

An object of the disclosure is to provide a control valve and a camshaft adjuster with such a control valve with optimized installation space requirement.

This object may be achieved by the features disclosed herein, while advantageous refinements and embodiments of the disclosure are also described. Accordingly, a control valve for a hydraulic camshaft adjuster is provided, with a housing and with a control piston mounted in a receiver of the housing, wherein several openings are provided on the inner casing surface of the receiver, at least some of which may be assigned to an inlet port P, a supply port A, a supply port B or a supply port C, and wherein the control piston comprises a first control groove, a second control groove and a third control groove which can each be connected to at least two openings of the housing depending on the position of the control piston relative to the housing. The object is achieved in that the first control groove can be brought into fluid-conductive connection with a first inlet opening assigned to the inlet port P and with an opening assigned to the supply port A, in that the second control groove can be brought into fluid-conductive connection with an opening assigned to the supply port A and/or with an opening assigned to the supply port B and/or with an opening assigned to the supply port C, and in that the third control groove can be brought into fluid-conductive connection with the first inlet opening or a second inlet opening assigned to the inlet port P and with an opening assigned to the supply port B.

According to the teaching of the disclosure, the installation space requirement of a generic control valve is optimized by the design with a second control groove which can be brought into fluid-conductive connection with the supply port C and the supply port A and/or the supply port B; in this way, hydraulic medium flowing out of the working chambers of a camshaft adjuster can be conducted via the supply port C, without the need for complex structural changes to the generic design.

In one embodiment, the housing is formed multi-piece and contains an outer housing and a guide sleeve surround-molded by plastic, wherein the control piston is mounted movably in the guide sleeve. Thus advantages result for the integration and installation of further components. This may for example be a seat for a spring which can press the control piston against a pressure pin of an electromagnetic actuator. Furthermore, a check valve unit may be arranged inside the valve housing.

In one refinement of the embodiment, an oil conduction structure is formed between the guide sleeve and the outer housing by the plastic surround-molding. This gives advantages with regard to flexibility, in that the control valve can be adapted to specific applications without great structural complexity.

In a further embodiment, the first control groove and the third control groove enclose the second control groove. The first and third control grooves of the control piston thus lie at the axially outermost positions, and the second control groove is arranged centrally. This embodiment is particularly advantageous with a view to optimizing the installation space, because in this way a fluid-conductive connection between the supply port C and the supply port A and/or B can be created at low cost. The supply port A and the supply port B preferably enclose the supply port C in the axial direction. The same applies to the opening assigned to the respective port on the valve housing or on the guide sleeve.

In one refinement of this embodiment, the control piston may assume a first switch position and a second switch position relative to the housing, wherein in the first switch position the third control groove stands in fluid-conductive connection with the inlet port P and the supply port B, and the second control groove stands in fluid-conductive connection with the supply port C and the supply port A, wherein in the second switch position the first control groove stands in fluid-conductive connection with the inlet port P and the supply port A, and the second control groove stands in fluid-conductive connection with the supply port C and the supply port B. The two switch positions can be set by actuation of the control piston by an electromagnetic actuator. In this configuration, the control valve may be designed as a 4/2-way directional control valve with 4 ports (supply ports A, B, C and inlet port P), wherein the inlet is branched inside the valve housing, preferably by an oil conduction sleeve. The outflow takes place either directly via the supply port C or indirectly via a component, preferably a volume accumulator, standing in fluid-conductive connection with the supply port C.

In one refinement of this embodiment, in the third switch position the first control groove stands in fluid-conductive connection with the inlet port P, the third control groove stands in fluid-conductive connection with the inlet port P, and the second control groove stands in fluid-conductive connection exclusively with the supply port C. The mutual relationship of the three switch positions corresponds to their numerical sequence in the axial direction. The refinement has proved advantageous insofar as a design optimized for installation space can be achieved. This also applies to the case where the third switch position is not actuated in a concrete application. Preferably, in the third switch position, the first control groove may stand in fluid-conductive connection exclusively with the inlet port P, and the third control groove may stand in fluid-conductive connection exclusively with the inlet port P. Leakages in the region of the control edges are disregarded.

In a further advantageous embodiment, the control valve is characterized by an inlet port P (axial inlet) formed on an end face of the valve housing. The axial inflow may preferably take place via a cavity of the camshaft. The advantage of this embodiment lies in the optimum connection to the general hydraulic medium circuit of the internal combustion engine. Preferably, the axial inlet may open into at least one axial channel which is preferably formed between the control sleeve and the inner peripheral face of the valve housing, and via a radial bore forms a connection between the axial inlet and a control groove of the control piston.

The object is furthermore achieved by a hydraulic camshaft adjuster with a stator and a rotor which enclose at least one pressure chamber divided into two hydraulically opposing working chambers A and B, and with a volume accumulator and with a control valve according to any of the embodiments described above, wherein the working chamber A stands in fluid-conductive connection with the supply port A, the working chamber B stands in fluid-conductive connection with the supply port B, and the volume accumulator stands in fluid-conductive connection with the supply port C. One of the working chambers is supplied with hydraulic medium via a supply port depending on the switch position of the control piston of the control valve. Advantageously, hydraulic medium can be discharged from a working chamber in that a pressure medium path to the outlet is formed via the supply port A or the supply port B, via the second control groove, via the supply port C and via the volume accumulator to be filled.

In one refinement, the volume accumulator may be brought into fluid-conductive connection with the working chamber A and the working chamber B. Preferably, the connection is created directly via a supply line which is secured by a check valve. The advantage of this embodiment is that an intake of air on adjustment of the camshaft adjuster is thus easily avoided.

In a further advantageous refinement, the volume accumulator has an outlet for discharge of hydraulic fluid to a reservoir (tank). A back-up of hydraulic medium can thus be avoided in a simple fashion.

BRIEF DESCRIPTION OF THE DRAWINGS

The disclosure is now explained in more detail in relation to an exemplary embodiment, with reference to the drawings, in which.

DETAILED DESCRIPTION

Figure 1:
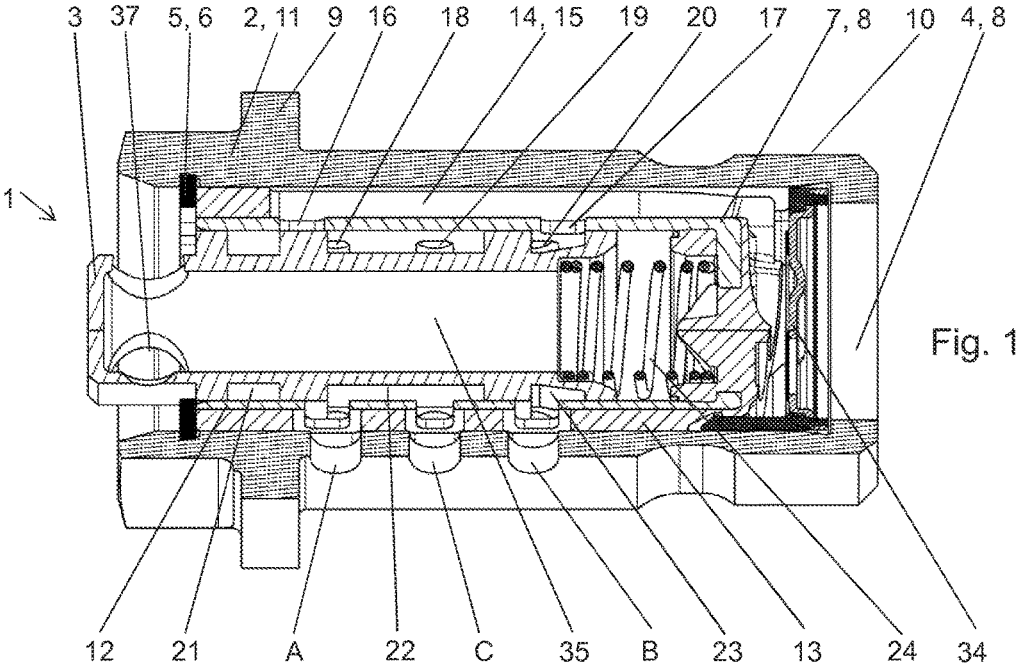
FIG. 1 shows a longitudinal section of a control valve in a first switch position.

FIG. 1 shows an embodiment of a control valve 1 in longitudinal section. The control valve 1 includes a valve housing 2 and a control piston 3 which has an open floor, a cavity 35, and four openings 37 on the piston head 36 for purging. The control piston 3 is guided axially movably in a corresponding cavity 4 of the valve housing 2. The adjustment range of the control piston 3 is axially limited by a lock ring 5 at the first end 6 and by a terminating element 7 at the second end 8. The valve housing 3 may be received by a cavity of a camshaft (not shown) and serve to control a camshaft adjuster (see FIG. 3). A flange 9 together with an external thread 10 serves for connection of the control valve 1 to the camshaft.

On its outer periphery, the valve housing 3 has three ports: the ports form a first supply port A, a second supply port B and a third supply port C, wherein the supply ports A and B enclose the supply port C. The valve housing 2 is formed multi-piece and contains an outer housing 11 and a guide sleeve 12 surround-molded by plastic, wherein the piston 3 is mounted movably in the guide sleeve 12. An oil conduction structure 14 is formed between the guide sleeve and the outer housing 11 by the plastic surround molding 13. The inlet port P (axial inlet) is formed on the end face of the valve housing 2, is secured by a check valve 34 and stands in fluid-conductive connection with the first and second inlet openings 16, 17 via a linear channel 15. Several openings 18, 19, 20 are arranged on the inner casing surface of the guide sleeve 12 and may be assigned optionally to the supply port A, the supply port B or the supply port C.

On its outer casing surface, the control piston 3 has four portions of wider diameter which enclose three portions of reduced diameter, namely the first, second and third control grooves 21, 22, 23. These, together with the inner casing surface of the valve housing, form a first, a second and a third peripheral ring channel. The first, second and third control grooves 21, 22, 23 can each be connected to at least two openings of the housing depending on the position of the control piston relative to the housing: the first control groove can be brought into fluid-conductive connection with a first inlet opening assigned to the inlet port P and with an opening assigned to the supply port A. The second control groove can be brought into fluid-conductive connection with an opening assigned to the supply port A and/or with an opening assigned to the supply port B and/or with an opening assigned to the supply port C. The third control groove can be brought into fluid-conductive connection with a second inlet opening 17 assigned to the inlet port P and with an opening assigned to the supply port B.

To control a camshaft adjuster, the control piston 3 may assume various switch positions which are characterized by the actual course of possible pressure medium paths. A switch position is implemented by an actuator device (not shown) which is usually an electromagnetically operated actuator.

A push rod connected to a stator of the electromagnet is brought into contact with an actuating face on the end of the control piston; the force acting on the stator is thus transmitted via the push rod to the control piston and causes its axial movement against the force of the spring 24: the control piston can thus assume a first switch position and a second switch position relative to the housing, wherein in the first switch position the third control groove 23 stands in fluid-conductive connection with the inlet port P and the supply port B, and the second control groove 22 stands in fluid-conductive connection with the supply port C and the supply port A.

Figure 2:
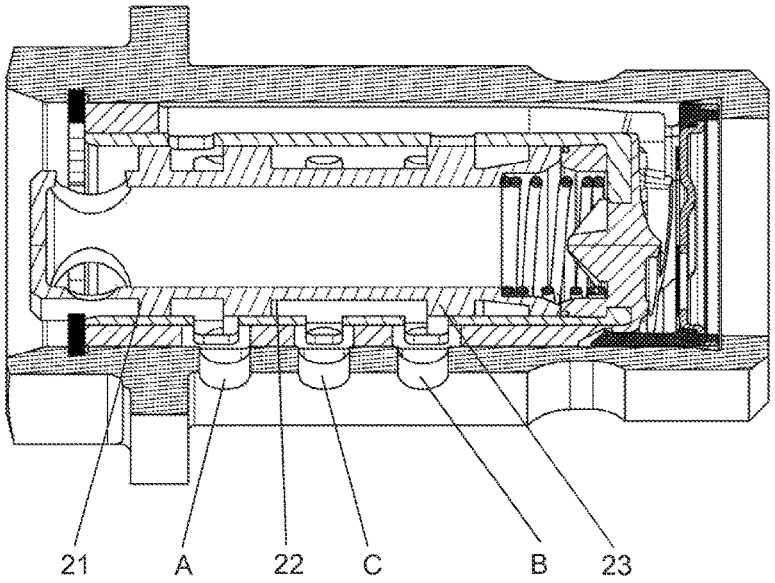
FIG. 2 shows a longitudinal section of the control valve from FIG. 1 in a second switch position.

In the second switch position shown in FIG. 2, the first control groove 21 stands in fluid-conductive connection with the inlet port P and the supply port A, and the second control groove 22 stands in fluid-conductive connection with the supply port C and the supply port B. Potentially, a third switch position may also be assumed in which the first control groove 21 stands in fluid-conductive connection with the inlet port P, the third control groove 23 stands in fluid-conductive connection with the inlet port P, and the second control groove 22 stands in fluid-conductive connection exclusively with the supply port C.

Figure 3:
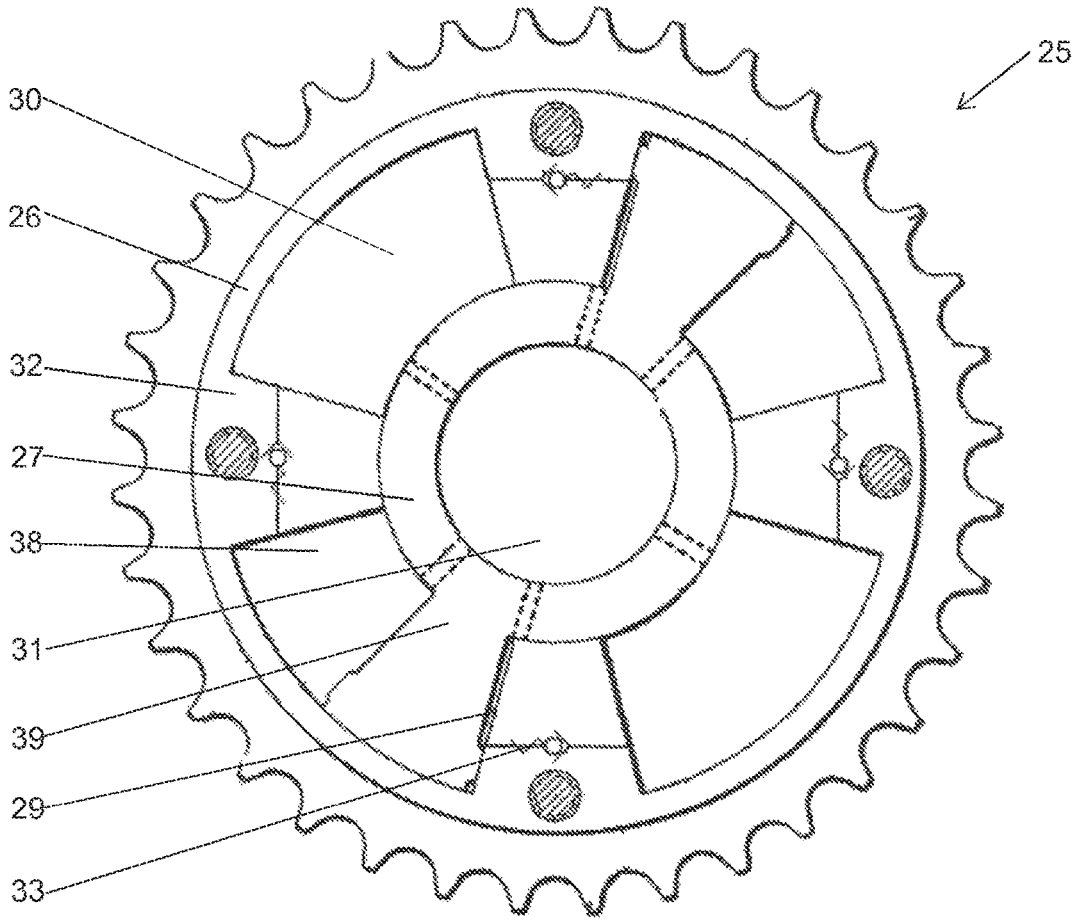
FIG. 3 shows a longitudinal section through a camshaft adjuster.

FIG. 3 shows a hydraulic camshaft adjuster 25 with a stator 26 and a rotor 27. Two pressure chambers 38 are shown, which are enclosed by the stator and rotor and are separated from each other by chamber walls 32, and each of which is divided by a vane 39 into two hydraulically opposed working chambers A and B (28, 29 respectively). The hydraulic camshaft adjuster also has a volume accumulator 30.

A receiver 31 for a control valve of the embodiment described above is arranged in the middle. The working chambers A (or 28) can each be brought into fluid-conductive connection with the supply port A, and the working chambers B can each be brought into fluid-conductive connection with the supply port B (or 29). The volume accumulator 30 can be brought into fluid-conductive connection with the supply port C.

In addition, the volume accumulator 30 can be brought into fluid-conductive connection with the working chamber A (or 28) and the working chamber B (or 29). To this end, the chamber walls 32 of the stator comprise hydraulic channels. An outflow of hydraulic medium from one of the working chambers 28, 29 to the volume accumulator 30 is prevented by the use of check valves 33. The volume accumulator 30 furthermore has an outlet which serves for the discharge of hydraulic medium to a reservoir (tank).

LIST OF REFERENCE SIGNS

1 Control valve
2 Valve housing, housing
3 Control piston
4 Cavity
5 Lock ring
6 First end
7 Terminating element
8 Second end
9 Flange
10 External thread
11 Outer housing
12 Guide sleeve
13 Plastic surround molding
14 Oil conduction structure
15 Linear channel
16 First inlet opening
17 Second inlet opening
18 Opening
19 Opening
20 Opening
21 First control groove
22 Second control groove
23 Third control groove
24 Spring
25 Camshaft adjuster
26 Stator
27 Rotor
28 Working chamber A
29 Working chamber B
30 Volume accumulator
31 Receiver
32 Chamber wall
33 Check valve
34 Check valve
35 Cavity
36 Piston head
37 Openings
38 Pressure chamber
39 Vane
P Inlet port P
A Supply port A
B Supply port B
C Supply port C
T Outlet port (tank, reservoir)

The invention claimed is:

1. A control valve for a hydraulic camshaft adjuster, comprising:

a housing and a control piston mounted in a receiver of the housing;

a plurality of openings provided on an inner casing surface of the receiver, at least one of the plurality of openings assigned to an inlet port P, a supply port A, a supply port B or a supply port C;

the control piston including a first control groove, a second control groove and a third control groove, either of the first, second, or third control grooves connected to at least two of the plurality of openings of the housing depending on a position of the control piston relative to the housing;

the first control groove configured to be brought into fluid-conductive connection with a first inlet opening assigned to the inlet port P and with an opening assigned to the supply port A;

the second control groove configured to be brought into fluid-conductive connection with an opening assigned to the supply port A and/or with an opening assigned to the supply port B and/or with an opening assigned to the supply port C;

the third control groove configured to be brought into fluid-conductive connection with the first inlet opening or a second inlet opening assigned to the inlet port P and with an opening assigned to the supply port B;

the first control groove and the third control groove enclose the second control groove; and in a first switch position of the control piston, the third control groove is in fluid-conductive connection with the inlet port P and the supply port B, and the second control groove is in fluid-conductive connection with the supply port C and the supply port A; and in a second switch position of the control piston, the first control groove is in fluid-conductive connection with the inlet port P and the supply port A, and the second control groove is in fluid-conductive connection with the supply port C and the supply port B.

2. The control valve as claimed in claim 1, wherein the housing is formed of multiple pieces and includes an outer housing and a guide sleeve surround-molded by plastic, wherein the control piston is mounted movably in the guide sleeve.

3. The control valve as claimed in claim 2, wherein an oil conduction structure is formed in the plastic between the guide sleeve and the outer housing.

4. The control valve as claimed in claim 1, wherein the control piston is configured to assume a third switch position relative to the housing, and in the third switch position the first control groove is in fluid-conductive connection with the inlet port P and the third control groove is in fluid-conductive connection with the inlet port P and the second control groove is in fluid-conductive connection exclusively with the supply port C.

5. The control valve as claimed in claim 1, wherein the inlet port P is an axial inlet port formed on an end face of the valve housing and, via a linear channel, is in fluid-conductive connection with the first and/or the second inlet opening.

6. A hydraulic camshaft adjuster with a stator and a rotor which enclose at least one pressure chamber divided by a vane into two hydraulically opposing working chambers A and B, and with a volume accumulator and with a control valve as claimed in claim 1, wherein the working chamber A is in fluid-conductive connection with the supply port A, the working chamber B is in fluid-conductive connection with the supply port B, and the volume accumulator is in fluid-conductive connection with the supply port C.

7. The hydraulic camshaft adjuster as claimed in claim 6, wherein the volume accumulator is configured to be brought into fluid-conductive connection with the working chamber A and the working chamber B.

8. The hydraulic camshaft adjuster as claimed in claim 7, wherein the volume accumulator has an outlet for discharge of hydraulic medium to a reservoir.

* * * * *